US008511227B2

(12) United States Patent
Hines

(10) Patent No.: US 8,511,227 B2
(45) Date of Patent: Aug. 20, 2013

(54) PRINTING PLATE REGISTRATION

(75) Inventor: Ryan K. Hines, New Westminster (CA)

(73) Assignee: Eastman Kodak Company, Rochester, NY (US)

( * ) Notice: Subject to any disclaimer, the term of this patent is extended or adjusted under 35 U.S.C. 154(b) by 744 days.

(21) Appl. No.: 12/700,788

(22) Filed: Feb. 5, 2010

(65) Prior Publication Data

US 2011/0192304 A1 Aug. 11, 2011

(51) Int. Cl.

| | |
|---|---|
| ***B41F 1/34*** | (2006.01) |
| ***B41F 3/08*** | (2006.01) |
| ***B41F 21/12*** | (2006.01) |
| ***B41F 21/14*** | (2006.01) |
| ***B41L 1/02*** | (2006.01) |
| ***B41L 3/02*** | (2006.01) |

(52) U.S. Cl.
USPC .. 101/481; 101/486; 101/415.1; 101/DIG. 36

(58) Field of Classification Search
USPC ..... 101/481, 486, DIG. 36, 485, 415.1, 101/382.1, 401.1
See application file for complete search history.

(56) References Cited

U.S. PATENT DOCUMENTS

| | | | | |
|---|---|---|---|---|
| 5,479,859 | A | 1/1996 | Lindner et al. | |
| 6,510,793 | B1 | 1/2003 | Kerr et al. | |
| 6,604,465 | B2 * | 8/2003 | Tice et al. | 101/415.1 |
| 6,755,132 | B1 | 6/2004 | Cummings | |
| 6,766,742 | B2 * | 7/2004 | Hashiguchi | 101/477 |
| 7,621,219 | B2 * | 11/2009 | Burgess et al. | 101/481 |
| 8,176,846 | B2 * | 5/2012 | Funk et al. | 101/477 |
| 8,210,104 | B2 * | 7/2012 | Funk et al. | 101/486 |
| 2007/0229638 | A1 | 10/2007 | McGaire | |
| 2008/0190312 | A1 * | 8/2008 | Schnell | 101/485 |

FOREIGN PATENT DOCUMENTS

| | | |
|---|---|---|
| WO | 2007/140269 | 12/2007 |

* cited by examiner

*Primary Examiner* — Daniel J Colilla
*Assistant Examiner* — Leo T Hinze
(74) *Attorney, Agent, or Firm* — Nelson Adrian Bush

(57) ABSTRACT

An apparatus for registering a printing plate includes a support surface. A first registration member provides an electrical signal to the printing plate when contact is established between the first registration member and a first edge of the printing plate. Each registration member in a set of two or more registration members receives the electrical signal provided to the printing plate when contact is established between an edge of the printing plate and the registration member. A set of two or more sensors detects a presence of the electrical signal received by a registration member. A plurality of actuators is operable for moving the printing plate towards a registration member. A controller determines a presence or absence of contact between the printing plate and a selected registration member based on information provided by each sensor. The controller selectively operates at least one of the actuators to move the printing plate towards the selected registration member.

16 Claims, 6 Drawing Sheets

PRINTING PLATE REGISTRATION

CROSS REFERENCE TO RELATED APPLICATIONS

Reference is made to commonly-assigned U.S. patent application Ser. No. 12/700,785 (now U.S. Publication No. 2011/0192303), filed Feb. 5, 2010, entitled IMPROVED DETECTION OF A MISREGISTERED PRINTING PLATE, by Hines, the disclosure of which is incorporated herein.

FIELD OF THE INVENTION

The invention relates to printing, and in particular to registering printing plates in an apparatus such as a computer-to-plate system. Registration of the printing plate can be required prior to subjecting the printing plate to a subsequent process such as the formation of an image on the printing plate or the formation of a registration feature on the printing plate.

BACKGROUND OF THE INVENTION

Contact printing using high volume presses is commonly employed to print a large number of copies of an image. A contact printing press typically utilizes a printing plate to apply a colorant to a surface to form an image thereon. The surface can form part of a receiver media (e.g. paper) or can form part of an intermediate component adapted to transfer the colorant from its surface to the receiver media (e.g. a blanket cylinder of a press). In either case, a colorant pattern is transferred to the receiver media to form an image on the receiver medium.

Printing plates typically undergo various processes to render them in a suitable configuration for use in a printing press. For example, exposure processes are used to form images on an imageable surface of a printing plate that has been suitably treated so as to be sensitive to light or heat radiation. One type of exposure process employs masks. The masks are typically formed by exposing highly sensitive film media using a laser printer known as an "image-setter." The film media can be additionally developed to form the mask. The mask is placed in area contact with a sensitized printing plate, which is in turn exposed through the mask. Printing plates exposed in this manner are typically referred to as "conventional printing plates." Some conventional lithographic printing plates are sensitive to radiation in the ultraviolet region of the light spectrum.

Another conventional method directly forms images on printing plates through the use of a specialized imaging apparatus typically referred to as a plate-setter. A plate-setter in combination with a controller that receives and conditions image data for use by the plate-setter is commonly known as a "computer-to-plate" or "CTP" system. CTP systems offer a substantial advantage over image-setters in that they eliminate film masks and associated process variations associated therewith. Printing plates imaged by CTP systems are typically referred to as "digital" printing plates. Digital printing plates can include photopolymer coatings (i.e. visible light plates) or thermo-sensitive coatings (i.e. thermal plates).

In many printing processes, a plurality of printing plates is used to apply different colorants to a receiver media. Typically, each printing plate applies a different colorant to the receiver media. In this way, the printed image formed on the receiver media can contain different colors. Each of the printing plates must be registered with respect to one another to form a printed image having a desired visual quality. Regardless of the manner by which an image is formed on a printing plate, it must be accurately positioned on the printing plate to achieve a desired registration with the images formed on other associated printing plates.

In some cases, registration features are formed in a printing plate to help register the printing plate on a printing press. The registration features can be formed by various processes including processes adapted to form perforations in the printing plate. A set of perforations can be used to define registration features comprising locating holes or locating channels adapted for providing a desired alignment with a corresponding set of registration features on printing press. It is noted that accurate registration requires that the registration features formed on a printing plate also be registered with the images formed on the printing plate. In some cases, the image forming process and the registration feature forming process are conducted by different apparatus. In other cases, the image forming process and the registration feature forming process are conduced by the same apparatus. In some cases, the image forming process precedes the registration feature forming process while in other cases, the opposite occurs. In some cases, a registration feature formed on a printing plate is employed to assist in the accurate placement of an image on the printing plate. In other cases, an image formed on a printing plate is employed to assist in the accurate placement of a registration feature on the printing plate.

In many cases, one or more edges of a printing plate are used for registration purposes during a processing of the printing plate. For example, during some processes, a printing plate is aligned on a support surface of an apparatus by bringing one or more of the plate edges known as "registration edges" into contact with various registration members. Various groupings of registration members are often employed to register printing plates to the support surface. "Three-point" registration is especially advantageous for rectangular or square shaped printing plates. Once a required contact is established between the printing plate and the registration members, the printing plate is deemed to be in a required registration for a subsequent processing such as the forming of an image or registration feature. Failure to establish the necessary contact between the printing plate and the registration members can introduce registration errors during the subsequent processing. The failure to establish the necessary contact between the printing plate and the registration members is referred to as "misregistration." Registration errors can lead to reduced quality in the finished printing plate and adversely impact the productivity of the plate making process.

Various conventional printing plate registration detection systems are known. For example, in commonly-assigned U.S. Pat. No. 6,510,793 (Kerr et al.), which is herein incorporated by reference, describe a electronic printing plate registration system in which registration is established when the edges of a printing plate contacts all of three electrically conductive members to create a short between the all of the three conductive members. In one embodiment, Kerr et al. teaches the use of a signal generator that generates an electrical signal at each of two of the three conductive members which act as "emitter" members. An electrical short detection system employs a short detector that senses both the electrical signals at the remaining third conductive member which acts a "receiver" member. In this regard, the electrical detector is adapted to detect both the electrical signals provided by the two "emitter" conductive members. Kerr et al. teaches the use of two signals having different characteristics (e.g. frequency) to determine whether a misregistration is created by an absence of contact between the printing plate and a particular one of the two emitter members. Although this electronic printing plate registration system can identify some misregistrations, it cannot identify others. In particular, this electronic printing plate registration system cannot distinguish between a first misregistration caused by an absence of contact between the printing plate and each of the two emitter members and a second misregistration caused by an absence of contact between the printing plate and the receiver member. In this regard, this uncertainty may hinder corrective actions in an automated system used to correct any misregistration.

There is a need for improved methods and apparatus for properly registering a printing plate during a printing plate processing operation.

There is a need for improved methods and apparatus for correcting a misregistration of a printing plate during a printing plate processing operation.

There is a need for improved methods and apparatus for accurately identifying which of a plurality of different printing plate misregistrations exist.

There is a need for automated methods for correcting an identified misregistration of printing plate during a printing plate processing operation.

There is a need for an imaging apparatus with improved printing plate registration abilities.

There is a need for a perforation apparatus with improved printing plate registration abilities.

SUMMARY OF THE INVENTION

Briefly, according to one aspect of the present invention an apparatus for registering a printing plate comprising an electrically conductive material including a support surface adapted for supporting the printing plate; a plurality of registration members comprising a first registration member adapted for providing an electrical signal to the printing plate when contact is established between the first registration member and a first edge of the printing plate, and a set of two or more registration members, each registration member in the set of two or more registration members adapted for receiving the electrical signal provided to the printing plate when contact is established between an edge of the printing plate and the registration member in the set of two or more registration members; a set of two or more sensors, each of the sensors adapted for detecting a presence of the electrical signal received by a registration member in the set of two or more registration members; a plurality of actuators, each of the actuators being individually operable for moving a portion of the printing plate towards a registration member of the plurality of registration members; and a controller configured for determining a presence or absence of contact between the printing plate and a selected registration member of the plurality of registration members based at least on information provided by each sensor in the set of two or more sensors, the controller being further configured for selectively operating at least one of the actuators to cause the printing plate to move towards the selected registration member in the event that an absence of the electrical signal is detected by at least one sensor in the set of two or more sensors.

The invention and its objects and advantages will become more apparent in the detailed description of the preferred embodiment presented below.

BRIEF DESCRIPTION OF THE DRAWINGS

Embodiments and applications of the invention are illustrated by the attached non-limiting drawings. The attached drawings are for purposes of illustrating the concepts of the invention and may not be to scale.

DETAILED DESCRIPTION OF THE INVENTION

Figure 1:
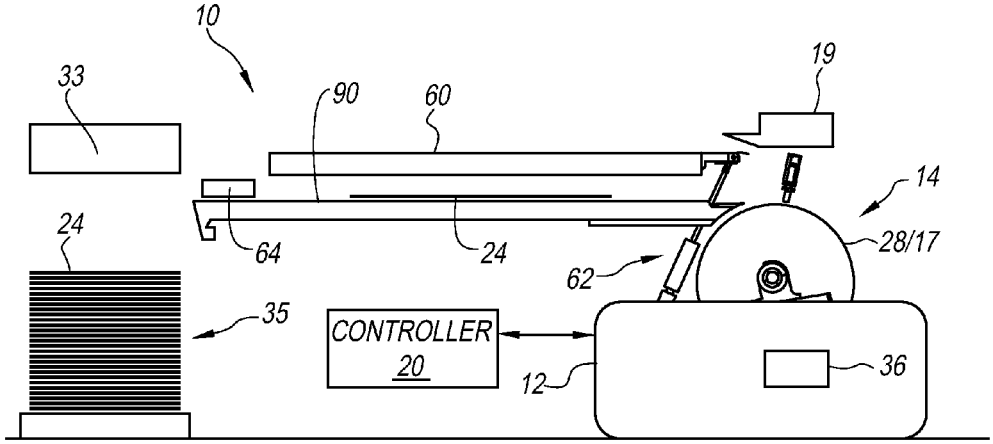
FIG. 1 shows an apparatus according to an example embodiment of the invention.

Throughout the following description specific details are presented to provide a more thorough understanding to persons skilled in the art. However, well-known elements may not have been shown or described in detail to avoid unnecessarily obscuring the disclosure. Accordingly, the description and drawings are to be regarded in an illustrative, rather than a restrictive sense.

FIGS. 1-4 schematically illustrate a printing plate imaging apparatus 10 as per an example embodiment of the invention. In the embodiment of FIGS. 1-4, imaging apparatus 10 is a computer-to-plate imaging apparatus. Imaging apparatus 10 comprises a frame 12 supporting an image recording system 14, a staging support surface 90, a plate exchange surface 17, a transfer support surface 60, a perforation system 19, and a controller 20.

Controller 20 can comprise a microprocessor such as a programmable general purpose microprocessor, a dedicated micro-processor or micro-controller, or any other system that can receive signals from various sensors, and from external and internal data sources and that can generate control signals to cause actuators and motors within imaging apparatus 10 to operate in a controlled manner to form imaged printing plates 24. Controller 20 can comprise a plurality of controllers.

Image recording system 14 comprises an imaging head 22 adapted to take image-forming actions within an image forming area of an imaging support surface 28 so that an image can be formed on each of one or more printing plates 24 loaded within the image forming area on imaging support surface 28. In the illustrated embodiment, a plurality of printing plates 24 including printing plate 24A and printing plate 24B is supported on imaging support surface 28. However, this is not limiting and in other embodiments, imaging support surface 28 may be capable of supporting a different number of printing plates 24 in a manner that allows imaging head 22 to form images on each of printing plates 24 held thereby. Printing plates 24A and 24B can include different sizes or substantially the same size as shown in the illustrated embodiment. In this example embodiment, each of the printing plates 24 includes an electrically conductive material. In some example embodiments, each printing plate 24 is made from an electrically conductive substrate. In some example embodiments, each printing plate 24 is formed from a plastic or other substrate having an electrically conductive layer or coating.

Imaging head 22 generates one or more modulated light beams or channels that apply image modulated energy onto printing plates 24A and 24B. Imaging head 22 can move along a sub-scanning axis SSA while a motor 36 or other actuator moves the imaging support surface 28 along a main scanning axis MSA such that image forming actions can be taken over an image forming area of imaging support surface 28 on which printing plates 24A and 24B are supported.

Imaging head 22 is illustrated as providing two light emission channel sources 30 and 32 which can each comprise, for example, a source of laser light and laser modulation systems (not illustrated) of a kind known to those of skill in the art each capable of taking image forming actions on printing plates 24 located within the image forming area. In some embodiments, light emission channel sources 30 and 32 can be independently controlled, each source applying modulated energy to printing plates 24A and 24B. In yet other embodiments of this type, a single light emission channel source can be used to generate a modulated light beam that can be directed across the entire image forming area.

In various embodiments, not illustrated, various types of imaging technology can be used in imaging head 22 to form an image pattern on printing plates 24A and 24B. For example, and without limitation, thermal printing plate image forming techniques known to those of skill in the art can be used. The choice of a suitable light emission source can be motivated by the type of printing plate 24 that is to be imaged.

In the embodiment of FIGS. 1-4, imaging support surface 28 illustrates an external drum-type of imaging support surface having a generally cylindrical exterior surface 34. Accordingly, in the embodiment of FIG. 2, main scanning axis MSA is illustrated as extending along an axis that is parallel to a direction of rotation of exterior surface 34. However, in other embodiments imaging support surface 28 can comprise an internal drum or a flatbed support surface. In the external drum embodiment illustrated, printing plates 24A and 24B are held on exterior surface 34 by clamping forces, electrostatic attraction, vacuum force or other attractive forces supplied respectively by plate clamps, electrostatic systems, vacuum systems or other plate attracting systems (not illustrated).

During imaging operations, controller 20 causes image modulated beams of light from imaging head 22 to be scanned over the imaging forming area by a combination of operating a main scanning motor 36 to rotate imaging support surface 28 along main scanning axis MSA and translating imaging head 22 in the sub-scanning direction by causing rotation of a threaded screw 38 to which light emission channel sources 30 and 32 are attached in a manner that causes them to advance in a linear fashion down the length of threaded screw 38 as threaded screw 38 is rotated. It is understood that other mechanical translation systems known in the art can be used for this purpose. In some embodiments, light emission channel sources 30 and 32 can be controlled to move independently of one another along sub-scanning axis SSA. In other example embodiments, other well-known light beam scanning systems, such as those that employ rotating mirrors, can be used to scan image modulated light across the image forming area of imaging support surface 28.

Figure 2:
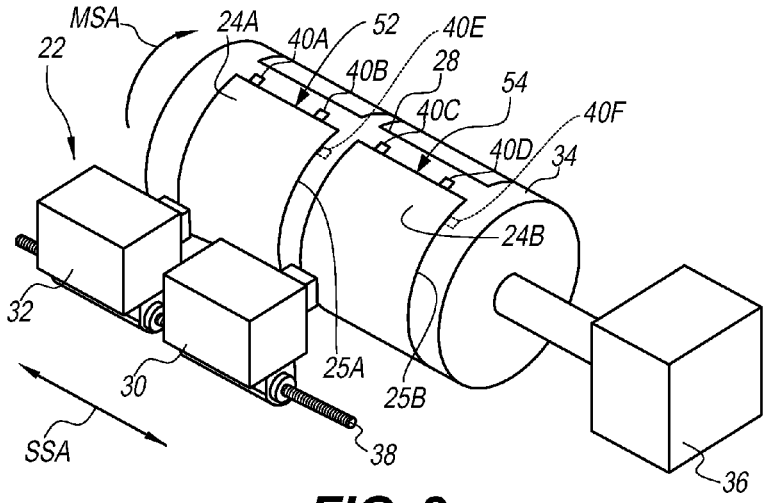
FIG. 2 shows a perspective view of an imaging head and imaging support surface of a type useful with the apparatus of FIG. 1.
Figure 3:
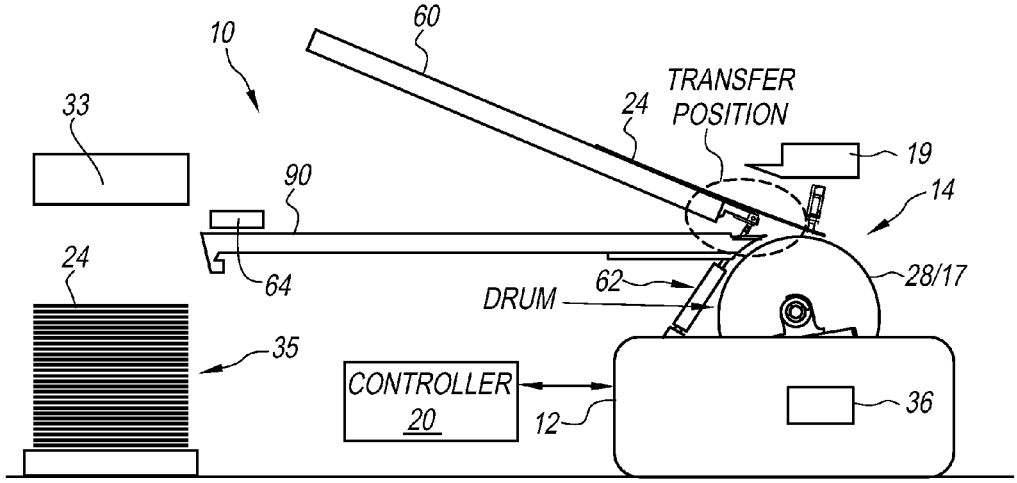
FIG. 3 shows a side view of the apparatus of FIG. 1 with a transport support surface in a transfer position.
Figure 4:
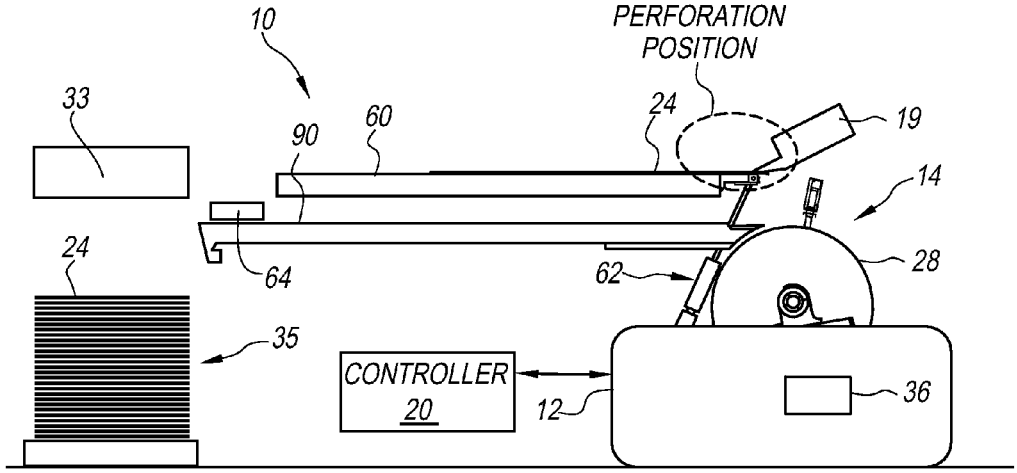
FIG. 4 shows a side view of the apparatus of FIG. 1 with the transport support surface in a perforation position.

As is shown in greater detail in FIG. 2, exterior surface 34 has various groupings of registration members including a first registration member 40A and a second registration member 40B associated with printing plate 24A, and a first registration member 40C and a second registration member 40D associated with printing plate 24B. In this example embodiment, printing plates 24A and 24B are positioned in contact with their associated registration members during an imaging operation to locate the printing plates along the main-scanning axis MSA.

First and second registration members 40A and 40B are arranged to help control the position of registration edge 52 of printing plate 24A along main scanning axis MSA. Similarly, registration members 40C and 40D are arranged to help control the position of registration edge 54 of printing plate 24B along main scanning axis MSA.

Alignment of the first and second printing plates 24A and 24B along sub-scanning axis SSA can be provided in various ways. In a preferred embodiment, imaging head 22 has an integral edge detector (not illustrated) that is adapted to sense lateral edges 25A and 25B of respective printing plates 24A and 24B as imaging head 22 is moved past the printing plates during imaging operations. In this example embodiment, each of lateral edges 25A and 25B has a substantially perpendicular orientation to respective registration edges 52 and 54. Controller 20 receives signals from the edge detector and adjusts imaging operations so that images are formed on printing plates 24A and 24B in precise relation to the sensed lateral edges 25A and 25B of printing plates 24A and 24B respectively. Typically, integral edge detectors include an optical sensor that detects an edge based upon differences in an amount of light reflected thereby. However, integral edge detectors can take other forms known to those of skill in the art including magnetic field detectors, electrical sensors, and contact detectors.

Alternatively, alignment along the sub-scanning axis SSA during imaging can be provided by additional third registration members 40E and 40F as illustrated in broken lines in FIG. 2. When employed, third registration members 40E and 40F are positioned for respective contact with lateral edges 25A and 25B to help accurately position printing plate 24A and printing plate 24B along sub-scanning axis SSA. In this regard, registration members 40A, 40B, and 40E define a three-point registration system for printing plate 24A during imaging, and registration members 40C, 40D, and 40F define a three point registration system for printing plate 24B during imaging.

In the embodiment illustrated, a staging support surface 90 is provided and is adapted to exchange various printing plates 24 (e.g. printing plates 24A and 24B) with imaging support surface 28. Printing plates 24 can be provided to staging support surface 90 for subsequent transfer to imaging support surface 28 in various ways. For example, plate handling mechanism 33 can be used to pick each printing plate 24 from one or more printing plate stacks 35 and transfer each printing plate 24 to staging support surface 90 by various methods as are well known in the art. Printing plate stacks 35 can be arranged or grouped in various manners, including by plate size, type, etc. Cassettes, pallets and other containing members are regularly employed to group a plurality of printing plates 24. The printing plates 24 in printing plate stack 35 are shown separated from one another for clarity. Interleave or slip-sheets can be employed to separate adjacent printing plates 24 from one another in printing plate stack 35.

Once a printing plate 24 is transferred to staging support surface 90, a plate positioning system 64 is operated to engage with a surface of the printing plate 24 and move it at least in part from staging support surface 90 onto imaging support surface 28 in this example embodiment. In this regard, it is desired that the printing plate 24 be transferred to imaging support surface 28 such that one of its edges is in contact and aligned with each of an associated set of registration members.

In this example embodiment, imaging apparatus 10 has a transfer support surface 60 and a positioning system 62. In this example embodiment, transfer support surface 60 is sized to receive, hold and/or deliver a plurality of printing plates 24 at the same time. In this example embodiment, positioning system 62 is connected between frame 12 and transfer support surface 60 and defines a movement path for transfer support surface 60 between a transfer position shown in FIG. 3 and a perforation position shown in FIG. 4.

When transfer support surface 60 is in the transfer position, printing plates 24A and 24B can be transferred between imaging support surface 28 and transfer support surface 60. Depending on the desired flow of the printing plates 24 through the apparatus 10, printing plates 24A and 24B can be transferred from transfer support surface 60 to imaging support surface 28, or from imaging support surface 28 to transfer support surface 60 when transfer support surface 60 is in the transfer position.

In this illustrated embodiment, printing plates 24 are transferred after they are imaged by imaging head 22. In this illustrated embodiment, transferred printing plates 24 can be perforated at the second position by perforation system 19. In this example embodiment, perforation system 19 perforates printing plates 24 with various punches and is herein referred to as punching system 19. While it is common in the industry for punches to be used to perforate printing plates, it will be appreciated that there are a variety of other ways in which the perforations can be formed. For example, and without limitation, laser cutting, thermal cutting, drilling, chemical etching, ablation, and other well known mechanical, chemical, and electrical processes can be employed. In some embodiments of the invention, printing plates 24 can be transferred to other systems for other forms of processing.

When transfer support surface 60 is in the perforation position, registration edges 52 and 54 of respective printing plates 24A and 24B are positioned proximate to various punches 73 (not shown In FIGS. 1-4) in punching system 19. In this example embodiment, punches 73 are employed to punch holes or detents or other forms in the printing plates 24 that can be used to form registration features. These registration features can be employed for various reasons including to align the printing plates 24 on a printing press.

Figure 5:
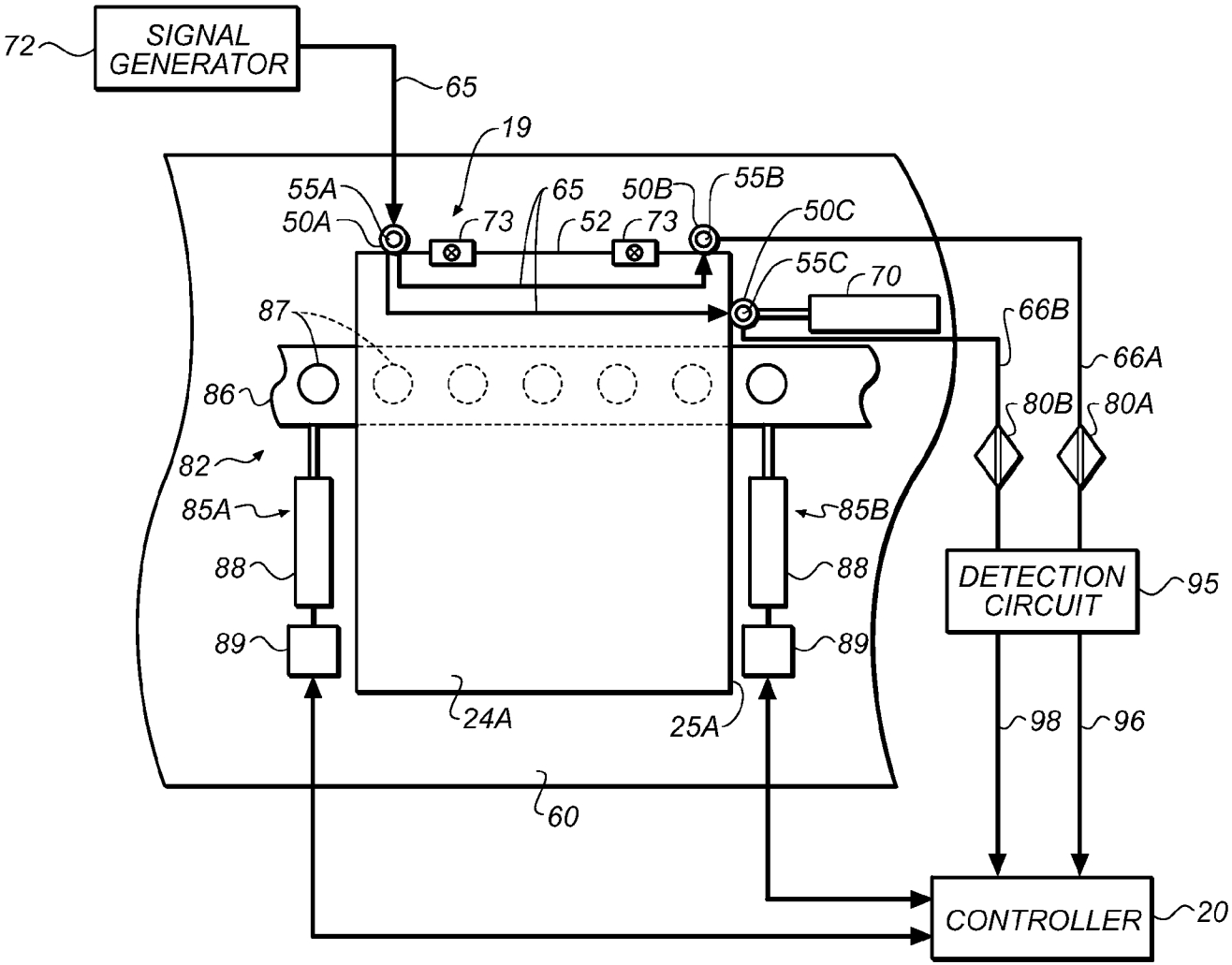
FIG. 5 schematically shows a portion of the apparatus of FIG. 1 including a plan view of a portion of the transfer support surface with a printing plate supported thereupon, a plurality of registration members, and punch system.

FIG. 5 schematically shows a portion of apparatus 10 including a plan view of a portion of transfer support surface 60 with a printing plate 24 (i.e. first printing plate 24A) supported thereupon, and punch system 19. In this example embodiment, a plurality of registration members are arranged so that various edges of printing plate 24A can be positioned against various ones of registration members. Registration members are positioned so that when various edges of printing plate 24A are positioned in contact with various ones of the registration members, the printing plate 24A will be accurately positioned so that registration features can be formed at desired locations on printing plate 24A by punches 73.

In this example embodiment, registration members include a first registration member 50A, a second registration member SOB, and a third registration member 50C. In this example embodiment, first and second registration members 50A and SOB assume fixed locations relative to transfer support surface 60. In this example embodiment, first and second registration members 50A and 50B are affixed to transfer support surface 60. In this example embodiment, it is desired that first and second registration members 50A and 50B be positioned for contact with a first edge of printing plate 24A. In this example embodiment, the first edge is registration edge 52. In this example embodiment, a mechanism is provided to permit movement of third registration member 50C relative to transfer support surface 60. In this example embodiment, third registration member 50C can be positioned at various locations under the influence of a drive 70 which can include a motor and transmission arrangement (not illustrated) or pneumatic or hydraulic cylinder (not illustrated) by way of non-limiting example. In operation, third registration member 50C is positioned against a second edge of printing plate 24A that is oriented substantially perpendicular to the first edge of printing plate 24A. In this example embodiment, the second edge is lateral edge 25A. In this example embodiment, drive 70 and third registration member 50C can be employed to laterally position printing plate 24A at a desired location relative to punches 73 used to form the registration features in printing plate 24A. In this example embodiment, the positioning of printing plate 24A relative to the first and second registration members 50A and 50B employed during the punching operation corresponds to the positioning of printing plate 24A relative to first and second registration members 40A and 40B during the imaging operation. In this regard, a spacing between first and second registration members 50A and 50B is selected to match a spacing between first and second registration members 40A and 40B. In some example embodiments, registration members 50A and 50B are selected from a plurality of sets of registrations members, each set being positioned to engage a different sized printing plate as described in commonly-assigned U.S. Pat. No. 6,755,132 (Cummings). Various members of the plurality of registration members can be positioned for contact with various printing plates 24 of a select size. In some example embodiments, one or both of registration members 50A and 50B are repositioned to various locations suitable for achieving a desired spacing there between. The repositioning of a registration member can include moving the registration member to a location suitable for contact with an edge of a printing plate 24. For example, a registration member can be repositionable between a first position which is recessed below transfer support surface 60 and a second position where the registration member protrudes from the transfer support surface 60 sufficiently to accommodate the desired contact with an edge of a printing plate 24. The repositioning of a registration member can include moving a surface of the registration member to a location suitable for contact with an edge of a printing plate 24. For example, a registration member can includes a cam-like surface wherein a portion of the surface is positioned for contact with an edge of a printing plate 24 when the registration member is rotated about an axis.

In this example embodiment, third registration member 50C is positioned to locate printing plate 24C such that substantially similar points on registration edge 52 are contacted by respective registration members during each of the imaging and punching operations thereby ensuring a substantially precise geometric relationship between the punched registration features and the image formed on printing plate 24A. In this example embodiment, third registration member 50C is positioned to move printing plate 24A to a desired location after printing plate 24A has been moved towards first and second registration members 50A and 50B. In this example embodiment, the position of third registration member 50C at the time of punching is determined by controller 20. In this example embodiment, when contact is established between registration edge 52 and each of first and second registration members 50A and 50B and between lateral edge 25A and third registration member 50C, printing plate 24A is said to be in registration and can be punched by punches 73.

Figure 6A:
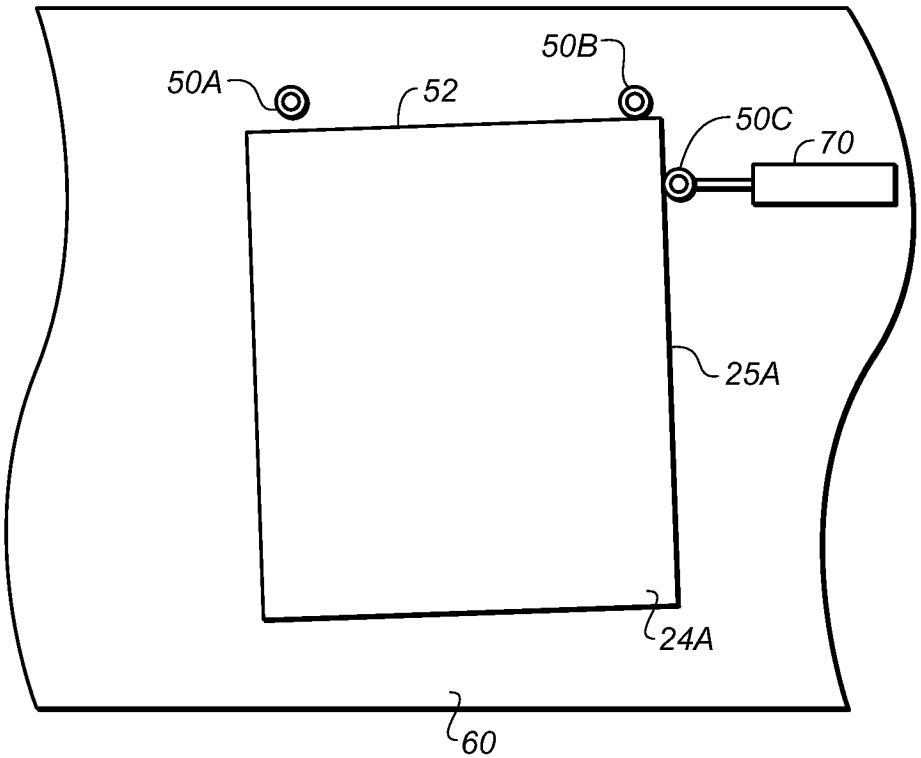
FIG. 6A shows a skewed misregistration caused by an absence of contact between a registration edge of a printing plate and a first registration member of the plurality of registration members of FIG. 5.
Figure 6B:
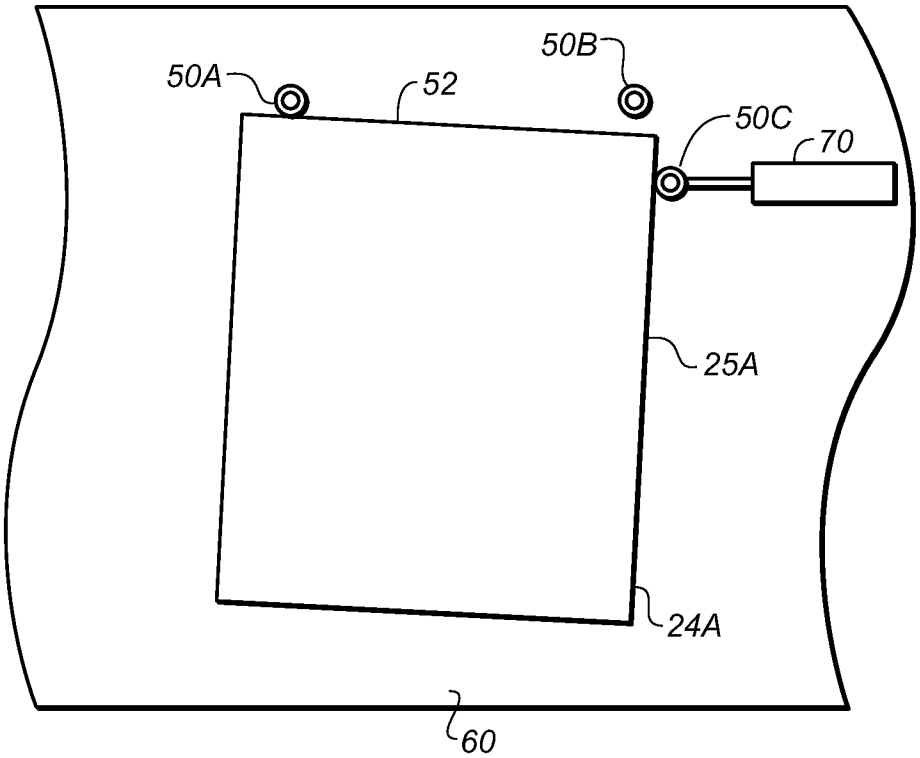
FIG. 6B shows a skewed misregistration caused by an absence of contact between a registration edge of a printing plate and a second registration member of the plurality of registration members of FIG. 5.
Figure 6C:
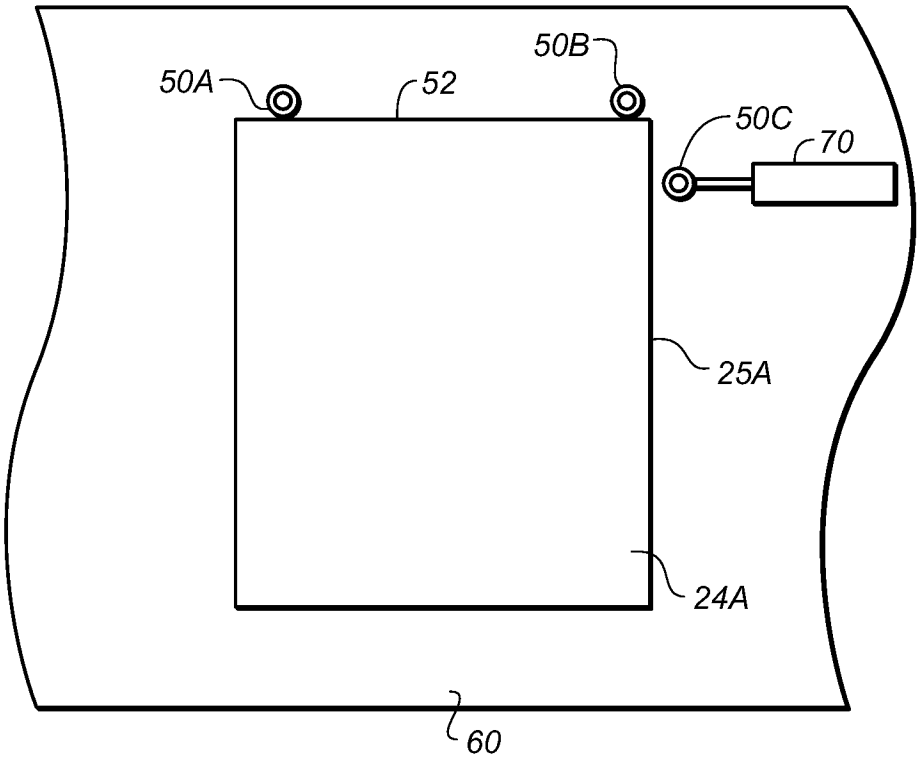
FIG. 6C shows an offset or lateral misregistration cause by an absence of contact between lateral edge of a printing plate and a third registration member of the plurality of registration members of FIG. 5.

In many cases, registration of a printing plate 24 is not achieved when the desired contact between the printing plate and an associated set of registration members is not established. For example FIGS. 6A, 6B, and 6C show different misregistrations caused by an absence of contact between printing plate 24A and various ones of first, second and third registration members 50A, 50B and 50C. In particular, FIG. 6A shows a skewed misregistration caused by an absence of contact between registration edge 52 and first registration member 50A. FIG. 6B shows a skewed misregistration caused an absence of contact between registration edge 52 and second registration member 50B. FIG. 6C shows an offset or lateral misregistration cause by an absence of contact between lateral edge 25A and third registration member 50C.

Referring back to FIG. 5, elements of apparatus 10 employed for detecting a misregistration between a printing plate (i.e. printing plate 24A in this embodiment) and a set of registration members 50 and correcting for the detected misregistration is schematically shown. In this example embodiment, signal generator 72 is adapted for providing an electrical signal 65 to first registration member 50A. In this example embodiment, first registration member 50A includes an electrically conductive portion 55A adapted for contacting a first edge of printing plate 24A. In this example embodiment, the first edge is registration edge 52. Electrical signal 65 received by first registration member 50A from signal generator 72 is in turn provided to the supported printing plate 24A when contact is made between the first registration member 50A and registration edge 52. In this example embodiment, electrical signal 65 can be provided to printing plate 24A when contact is established between electrically conductive portion 55A and registration edge 52. In this example embodiment, first registration member 50A is referred to as the "signal emitter member".

In this example embodiment, second registration member 50B and third registration member 50C are part of the registration members adapted to receive electrical signal 65 when electrical signal 65 is conveyed through the supported printing plate 24A along a path away from first registration member 50A. In this example embodiment, electrical signal 65 will be received by at least one of the second registration member 50B and the third registration member 50C when contact is established between the first registration member 50A and the registration edge 52 and contact is established between each of the at least one of the second registration member 50B and the third registration member 50C and an edge of printing plate 24A. In this example embodiment, second registration member 50B will receive electrical signal 65 through printing plate 24A when contact is established between registration edge 52 and an electrically conductive portion 55B of the second registration member 50B. In this example embodiment, third registration member 50C will receive electrical signal 65 through printing plate 24A when contact is established between an electrically conductive portion 55C of the third registration member 50C and a second edge of printing plate 24A (i.e. lateral edge 25A in this example embodiment). In this example embodiment, each of second registration member 50B and third registration member 50C is referred to as a "signal receiver member." In this example embodiment, electrical signal 65 can travel through a portion of printing plate 24A comprising an electrically conductive material. In this example embodiment, each of the first, second, and third registration members 50A, 50B, and 50C are electrically isolated from each other. In this example embodiment, electrical signal 65 can only flow from the signal emitter member to a signal receiver member via a path through printing plate 24A.

Apparatus 10 includes a set of two or more sensors including a first sensor 80A corresponding to second registration member 50B and a second sensor 80B corresponding to third registration member 50C. Each of the sensors is adapted for detecting a presence or absence of electrical signal 65 received by a respective one of second and third registration members 50B and 50C. In this example embodiment, a presence or absence of electrical signal 65 at either second registration member 50B or third registration member 50C is communicated to a respective one sensors via respective conductors 66A and 66B. In this example embodiment each of conductors 66A and 66B are respectively coupled to electrically conductive portions 55B and 55C. Various sensors known in the art can be employed in embodiments of the present invention. For example, various touch sensors can be employed. In some example embodiments, electrical continuity sensors have been employed by the present inventors. The selection of a particular sensor may be motivated by a particular characteristic of electrical signal 65. Electrical signal 65 can include various types of signals including voltage signals and current signals.

Because even a small separation between printing plate 24A and any of first, second, and third registration members 50A, 50B, and 50C can, cause significant registration errors during a processing of printing plate 24A, apparatus 10 is adapted to electronically determine when an absence of contact between printing plate 24A and any one of the first, second and third registration members 50A, 50B, and 50C occurs. Unlike other prior art printing plate registration detection systems, apparatus 10 is further adapted to identify the particular ones of the plurality of registration members which are not contacted by an edge of a printing plate 24 and initiate an automated response to reestablish contact between the printing plate 24 and the identified ones of the plurality of registration members. The accurate identification occurs regardless if the non-contacted registration member acts as a signal emitter member or acts as a signal receiver member.

In the illustrated embodiment of the present invention, when contact is established between various edges of print plate 24A and each of the first, second and third registration members 50A, 50B, and 50C, electrical signal 65 can be conveyed through printing plate 24A from first registration member 50A to each of second registration member 50B and third registration member 50C. A lack of contact between a printing plate edge and various ones of the first, second and third registration members 50A, 50B, and 50C will have a bearing on whether or not electrical signal 65 is detected by a given one of first sensor 80A and second sensor 80B. In this example embodiment, a detection circuit 95 is employed to condition information provided by each first sensor 80A and second sensor 80B for use by controller 20. In this example embodiment, each of first sensor 80A and second sensor 80B provides electrical continuity information to detector circuit 95. In this example embodiment, detector circuit 95 provides this information to controller 20 in a suitable format for use in controller 20. In this example embodiment, detector circuit 95 provides a first signal 96 corresponding to second registration member 50B and a second signal 98 corresponding to third registration member 50C. Each of the signals 96 and 98 comprises digital state information associated with a respective one of the second registration member 508 and the third registration member 50C. In this example embodiment, an ON digital state corresponds to a condition corresponding to a presence of the electrical signal 65 at an associated one of the second and third registration members 50B and 50C. In this example embodiment, an OFF digital state corresponds to a condition corresponding to an absence of the electrical signal 65 at an associated one of the second and third registration members 50B and 50C.

In this example embodiment, a plate positioning system 82 is employed to position against printing plate 24A in a desired orientation. Plate positioning system 82 includes a plurality of actuators including a first actuator 85A and a second actuator 85B. Actuators are employed to establish relative movement between printing plate 24A and first and second registration members 50A and 50B so as to position printing plate 24A such that registration edge 52 contacts each of these two registration members. In some example embodiments, each of the first and second actuators 85A and 85B are adapted to engage an edge which is opposite to registration edge 52. In this example embodiment, first and second actuators 85A and 85B are coupled to an intermediate or gripping member 86 adapted to grip a surface of printing plate 24A. In this example embodiment, gripping member 86 includes various gripping elements 87 (i.e. some shown in broken lines) adapted to grip printing plate 24A. Suitable gripping elements 87 can include suction/vacuum cups or mechanical grippers or clamps by way of non-limiting example. In various example embodiments of the invention, each of the first and second actuators 85A and 85B is selectively operable for moving a portion of printing plate 24A towards a registration member positioned to intercept registration edge 52.

Actuators can include various suitable actuators to establish the required positioning. In this example embodiment, variable force actuators 85 are employed. Although positional actuators can be employed to position printing plate 24A to various selected positions, additional sensing elements are required to avoid potential damage to printing plate during the positioning. Potential damage can include deformations in registration edge 52 created by excessive contact stresses that can be created between registration edge 52 and a registration member when a positional actuator is controlled to position registration edge 52 to a target location that does not accurately reflect the desired location of contact. Accordingly, when positional actuators are employed, additional sensing elements such as contact sensors or positional sensors are typically required.

In this example embodiment, each of first actuator 85A and second actuator 85B are variable force actuators. Each of the variable force actuators 85 is adapted to apply a selected force to a portion of printing plate 24A to move that portion towards one of the first registration member 50A and the second registration member 50B. In this example embodiment, each of the variable force actuators includes a pneumatic double acting pneumatic cylinder 88 and variable pressure regulator 89 adapted for varying a fluid pressure applied to the pneumatic cylinder 88. It is understood that other forms of variable force actuators can be employed in other example embodiments of the invention. In this example embodiment, the force applied by each of the actuators to a respective portion of printing plate 24A is selected to be sufficient to overcome inertial and frictional forces associated with printing plate 24A. In this example embodiment, the force applied by each of the actuators to a respective portion of printing plate 24A is sufficient to overcome inertial and frictional forces associated with gripping member 86. In this example embodiment, the force applied by each of the actuators to a respective portion of printing plate 24A is selected to reduce occurrences of damage to printing plate 24A created by excessive contact stresses generated between registration edge 52 and a registration member. Accordingly, the forces that are applied to printing plate 24A are sufficient to move it towards first and second registration members 50A and 50B while being insufficient to impart contact stress deformations on registration edge 52.

In this example embodiment, after first and second actuators 85A and 85B are operated to move printing plate 24A towards first and second registration members 50A and 50B, drive 70 is operated to move registration member 50C towards printing plate 24A to establish contact between registration member 50C and lateral edge 25A. Once registration member 50C is finally positioned, one may expect that contact between printing plate 24A and each of first, second and third registration members 50A, 50B, and 50C has been established and that an initial registration has been achieved. However, this is not always the case since misregistrations between a printing plate 24 and a set of registration members can occur for various reasons. For example, some misregistrations can occur as a printing plate 24 is moved onto a support surface associated with a subsequent processing step. Some misregistrations can occur when a printing plate 24 is secured to a support surface in preparation for a subsequent processing. Some misregistrations can occur when a printing plate 24 undergoes the process itself such as imaging or punching. In this case, even the act of moving third registration member 50C to a final position can cause printing plate 24A to pivot at a point in the vicinity of one of the first and second registration members 50A and 50B or at some other point and lead to a misregistration.

In this example embodiment, controller 20 is employed to determine if a lack of contact exists between printing plate 24A and any of first, second and third registration members 50A, 50B, and 50C. If a lack of contact with any of the first, second and third registration member 50A, 50B, and 50C is determined, actions are then initiated to establish contact with the relevant registration member. In this example embodiment, controller 20 compares the digital state information provided by signals 96 and 98 to make this determination. In this regard, signal 96 will either include information comprising an ON state or an OFF state which reflects the presence or absence of electrical signal 65 at second registration member 50B. In a similar manner, signal 98 will include information comprising and ON state or OFF state which reflects the presence or absence of the electrical signal 65 at the third registration member 50C.

Controller 20 compares the digital information provided by each of signals 96 and 98 to determine if contact is established between printing plate 24A and various ones of the first, second, and third registration members 50A, 50B, and 50C. In this example embodiment, the following LOGIC TABLE I is employed to make the determination:

LOGIC TABLE I

| Signal 96 | Signal 98 | Determination |
|---|---|---|
| OFF | OFF | Absence of Printing Plate Contact with First Registration Member 50A |
| OFF | ON | Absence of Printing Plate Contact with Second Registration Member 50B |
| ON | OFF | Absence of Printing Plate Contact with Third Registration Member 50C |
| ON | ON | Registration Achieved |

According to LOGIC TABLE I, if each of signals 96 and 98 comprises OFF states, controller 20 determines that an absence of contact exists between printing plate 24A and first registration member 50A. In this regard, an absence of contact between printing plate 24A and first registration member 50A does not allow first registration member to act as a signal emitter member for electrical signal 65, and thus electrical signal 65 would not be detected by either of second registration member 50B and third registration member 50C. It is to be noted that although this condition could also be interpreted as an absence of contact between printing plate 24A and both of second registration member 50B and third member 50C, this condition is unlikely since a plurality of signal receiver members (i.e. second and third registration members 50A and 50B) are employed thereby reducing occurrences in which an absence of contact with all of the signal receiver members exists.

In the second case where first signal 96 comprises an OFF state and second signal 98 comprises and ON state, controller 20 determines that an absence of contact exists between printing plate 24A and second registration member 50B. This particular determination is made on the basis that second signal 98 indicates that electrical signal 65 was received by third registration member 50C thereby indicating that contact between printing plate 24A and the registration members 50 is such an electrical path exists only between first registration member 50A and third registration member 50C but not between first registration member 50A and second registration member 50B. Conversely, in the third case where first signal 96 comprises an ON state and second signal 98 comprises an OFF state, controller 20 determines that an absence of contact exists between printing plane 24A and third registration member 50C. This particular determination is made on the basis that first signal 96 indicates that electrical signal 65 was received by second registration member 50B thereby indicating that contact between printing plate 24A and the registration members 50 is such that an electrical path exists only between first registration member 50A and second registration member 50B but not between first registration member 50A and third registration member 50C.

In the fourth case, where each of the signals 96 and 98 comprise an ON state, controller 20 determines that contact exists between each of the first, second and third registration members 50A, 50B, and 50C since the two ON states indicate that an electrical path exists between first registration member 50A and second registration member 50B and between first registration member 50A and third registration member 50C. In this regard, controller 20 determines that registration has been achieved.

In various example embodiments, controller 20 is employed to determine if printing plate 24A is registered by a process that includes selecting one of the first, second and third registration members 50A, 50B, and 50C and determining if contact exists between the selected registration member 50 and printing plate 24A. This analysis is made for each of the first, second and third registration members 50A, 50B, and 50C. In some example embodiments, a presence or absence of contact between printing plate 24A and any selected one of the first, second and third registration members 50A, 50B, and 50C is determined based at least on the detected presence or absence of electrical signal 65 at each of at least two of the registration members. In this example embodiment, a presence or absence of contact between printing plate 24A and any selected one of the first, second and third registration members 50A, 50B, and 50C is determined based at least on the detected presence or absence of the electrical signal 65 at each of the second registration member 50B and the third registration member 50C. In some example embodiments, a presence or absence of contact between printing plate 24A and a selected one of the first, second and third registration members 50A, 50B, and 50C is determined based at least on the detected presence or absence of the electrical signal 65 at another of the registration members.

In this example embodiment, when the first registration member 50A is selected, a presence or absence of contact between the printing plate 24A and the first registration member 50A is determined based at least on the detected presence or absence of the electrical signal 65 at each of two of the registration members, each of the two registration members being other than the first registration member 50A. In this particular embodiment, the two registration members include the second registration member 50B and the third registration member 50C. In this example embodiment, when one of the second registration member 50B and the third registration member 50C is selected, a presence or absence of contact between the selected registration member is determined based at least on the detected presence or absence of the electrical signal 65 at the selected one of the second and third registration members 50B and 50C as well as the detected presence or absence of the electrical signal 65 at the other of the second and third registration members 50B and 50C that has not been selected.

In various example embodiments of the invention, controller 20 is configured for selecting and operating at least one of first actuator 85A and second actuator 85B to move a portion of printing plate 24A towards a selected registration member in the event that an absence of the electrical signal 65 is detected by at least one sensor in the set of sensors. In various example embodiments, one of the actuators is selectively operated to move a portion of printing plate 24A towards a selected registration member in the event that an absence of the electrical signal 65 is detected at each of a plurality of registration members other than the selected registration member. For example, when first registration member 50A is selected, controller 20 is configured to cause first actuator 85A to reduce a spacing between printing plate 24A and first registration member 50A in the event that an absence of electrical signal 65 is detected at each of the second and third registration members 50B and 50C. In some example embodiments, one of the actuators is selectively operated to move a portion of the printing plate 24A towards a selected registration member in the event that an absence of the electrical signal 65 is detected at one of a set of two or more of the registration members and a presence of the electrical signal 65 is detected at another registration member of the set of two or more registration members 50. For example, when the second registration member 50B is selected, controller 20 is configured to cause second actuator 85B to reduce a spacing between printing plate 24A and second registration member 50B in the event that an absence of electrical signal 65 is detected at the selected second registration 50B and a presence of the electrical signal 65 is detected at the third registration member 50C. In this example embodiment, when the third registration member 50C is selected, controller 20 is configured to cause drive 70 to create relative movement between the between printing plate 24A and third registration member 50C to reduce a spacing between the two in the event that an absence of electrical signal 65 is detected at the selected third registration 50C and a presence of electrical signal is detected at second registration member 50B. In some example embodiments, relative movement between printing plate 24A and the third registration member 50C can include cycling the registration member 50C so that it moves both away and towards lateral edge 25A.

In various example embodiments, selective ones of first actuator 85A, second actuator 85B and drive 70 are operated to correct for a determined absence of contact between printing plate 24A and a particular one of the registration members. The particular one of the registration members can be identified based on the detected presence of the electrical signal 65 at another of the registration members. In this manner, various example embodiments of the invention can include automated systems for identifying a particular misregistration of printing plate 24A as well as automated systems for correcting the identified misregistration. In some example embodiments, once actions to correct an absence of contact between a printing plate 24 and a particular one of registration members has been initiated, additional steps can be undertaken to determine if the presence of contact subsequently exists at the particular registration member and/or whether a presence of contact between the printing plate 24 and another of the registration members exists, or has been maintained.

In this example embodiment, when an absence of contact is detected between printing plate 24A and one of the first registration member 50A and the second registration member 50B, the actuator in the closest proximity to the non-contacted registration member is controlled to establish the required contact. Since each of the actuators are variable force actuators in this example embodiment, controller 20 controls the relevant actuator to increase its output force to move printing plate 24A into contact with the non-contacted registration member. In some example embodiments, controller 20 can cause the relevant actuator force to increase by 10% or less of the nominal force used to initially position printing plate 24A. In other example embodiments, controller 20 can cause the relevant actuator force to increase by 5% or less of the nominal force used to initially position printing plate 24A. In yet other example embodiments, controller 20 can cause the relevant actuator force to increase by 2% or less of the nominal force used to initially position printing plate 24A. The amount of increase in the actuator force employed may be motivated by various factors including the ability of printing plate 24A to withstand potential damage as it makes contact with a registration member. In some example embodiments, after the relevant actuator has been operated to establish contact with a non-contacted registration member, the presence of contact with this registration member is re-checked. If an absence of contact is still present, the relevant actuator can be again operated to increase the force by a predetermined amount. In some embodiments, the predetermined amount of force increase is the same as that employed in a previous operation of the relevant actuator while in other embodiments, it is different. In some example embodiments this process is repeated a number of times until contact is established or until a predetermined number of cycles has been reached.

It is to be notated that the nominal force employed by each of the actuators 85 during an initial attempt to position the printing plate 24A against various one registration members can vary among the actuators. For example, this force can vary in accordance with a positioning of each actuator relative to an associated one of the registration members. In this manner, reaction forces associated with any moments arising from the application of the actuator forces can be compensated for. In this example embodiment, the force provided by each of first actuator 85A and second actuator 85B is altered by an associated pressure regulator 89 under the influence of controller 20.

Once a presence of contact between printing plate 24A and each of the first, second and third registration members 50A, 50B, and 50C has been determined to exist, printing plate 24A is deemed to be registered and a subsequent processing of the printing plate 24A can be undertaken. In this example embodiment, controller 20 operates punch system 19 to perforate printing plate 24A. In other example embodiments, controller 20 can be operated to form one or more images on a surface of printing plate 24A once it has been registered. It is understood that other forms of processing can be undertaken in other example embodiments of the invention.

Various example embodiments of the invention have been described in terms of registering a printing plate 24 on a punching support surface (i.e. transfer support surface 60). It is to be noted however, that any suitable support surface adapted to receive and support a printing plate 24 can be employed by the present invention. One such example of a suitable support surface is imaging support surface 28.

In the described example embodiments, image recording system 14 and punch system 19 were part of a common apparatus 10. In other example embodiments, different apparatus may be employed.

In the described example embodiments, a combination of three registration members has been described. However, consistent with the principles of the present invention, additional registration members can be incorporated in other embodiments. It will be appreciated that a printing plate 24 may have other edge features that can require different arrangements of registration members.

The invention has been described in detail with particular reference to certain preferred embodiments thereof, but it will be understood that variations and modifications can be effected within the scope of the invention.

PARTS LIST

| | |
|---|---|
| 10 | imaging apparatus |
| 12 | frame |
| 14 | image recording system |
| 17 | plate exchange surface |
| 19 | perforation/punch system |
| 20 | controller |
| 22 | imaging head |
| 24 | printing plates |
| 24A | printing plate |
| 24B | printing plate |
| 25A | lateral edge |
| 25B | lateral edge |
| 28 | imaging support surface |
| 30 | light emission channel source |
| 32 | light emission channel source |
| 33 | plate handling mechanism |
| 34 | exterior surface |
| 35 | printing plate stack |
| 36 | motor |
| 38 | threaded screw |
| 40A | first registration member |
| 40B | second registration member |
| 40C | first registration member |
| 40D | second registration member |
| 40E | third registration member |
| 40F | third registration member |
| 50A | first registration member |
| 50B | second registration member |
| 50C | third registration member |
| 52 | registration edge |
| 54 | registration edge |
| 55A | electrically conductive portion |
| 55B | electrically conductive portion |
| 55C | electrically conductive portion |
| 60 | transfer support surface |
| 62 | positioning system |
| 64 | plate positioning system |
| 65 | electrical signal |
| 66A | conductor |
| 66B | conductor |
| 70 | drive |
| 72 | signal generator |
| 73 | punches |

-continued

| PARTS LIST | |
|---|---|
| 80A | first sensor |
| 80B | second sensor |
| 82 | plate positioning system |
| 85A | first actuator |
| 85B | second actuator |
| 86 | gripping member |
| 87 | gripping elements |
| 88 | cylinder |
| 89 | pressure regulator |
| 90 | staging support surface |
| 95 | detection circuit |
| 96 | first signal |
| 98 | second signal |
| MSA | main scanning axis |
| SSA | sub-scanning axis |

The invention claimed is:

1. Apparatus for registering a printing plate comprising an electrically conductive material, the apparatus comprising:

a support surface adapted for supporting the printing plate;

a plurality of registration members comprising a first registration member adapted for providing an electrical signal to the printing plate when contact is established between the first registration member and a first edge of the printing plate, and a set of two or more registration members, each registration member in the set of two or more registration members adapted for receiving the electrical signal provided to the printing plate when contact is established between an edge of the printing plate and the registration member in the set of two or more registration members;

a set of two or more sensors, each of the sensors adapted for detecting a presence of the electrical signal received by a registration member in the set of two or more registration members;

a plurality of actuators, each of the actuators being individually operable for moving a portion of the printing plate towards a registration member of the plurality of registration members;

a controller configured for determining a presence or absence of contact between the printing plate and a selected registration member of the plurality of registration members based at least on information provided by each sensor in the set of two or more sensors, the controller being further configured for selectively operating at least one of the actuators to cause the printing plate to move towards the selected registration member in the event that an absence of the electrical signal is detected by at least one sensor in the set of two or more sensors;

wherein the set of two or more registration members comprises a second registration member, and the plurality of actuators comprises a first actuator operable for moving a first portion of the printing plate towards the first registration member and a second actuator operable for moving a second portion of the printing plate towards the second registration member; and comprising a gripping member adapted for gripping a surface of the printing plate, each of the first actuator and the second actuator being adapted for moving the gripping member.

2. The apparatus of claim 1, wherein the second registration member is positioned for contact with the first edge of the printing plate.

3. The apparatus of claim 2, wherein the set of two or more registration members comprises a third registration member positioned for contact with a second edge of the printing plate, the second edge being oriented substantially perpendicular to the first edge.

4. The apparatus of claim 1, wherein each of the first actuator and the second actuator are coupled to the gripping member.

5. The apparatus of claim 1, wherein each of the first portion of the printing plate and the second portion of the printing plate are located on the first edge.

6. The apparatus of claim 5, wherein each of the first actuator and the second actuator are positioned to engage an edge of the printing plate opposite to the first edge.

7. The apparatus of claim 5, wherein the set of two or more registration members comprises a third registration member positioned for contact with a second edge of the printing plate, the second edge being oriented substantially perpendicular to the first edge.

8. The apparatus of claim 7, wherein each of the first registration member and the second registration member is affixed to the support surface and the third registration member is moveable relative to the support surface.

9. The apparatus of claim 7, wherein the third registration member is moveable relative to the support surface and the controller is configured to operate a drive to cause the third registration member to move along a path towards the second edge.

10. The apparatus of claim 7, wherein the plurality of sensors comprises a first sensor adapted for detecting the presence of the electrical signal received by the second registration member when contact is established between the second registration member and the first edge, and a second sensor adapted for detecting the presence of the electrical signal received by the third registration member when contact is established between the third registration member and the second edge.

11. The apparatus of claim 10, wherein the controller is configured to selectively operate the first actuator to move the first portion of the printing plate towards the first registration member in the event that an absence of the electrical signal is detected by the first sensor and an absence of the electrical signal is detected by the second sensor.

12. The apparatus of claim 10, wherein the controller is configured to selectively operate the second actuator to move the second portion of the printing plate towards the second registration member in the event that an absence of the electrical signal is detected by the first sensor and a presence of the of the electrical energy is detected by the second sensor.

13. The apparatus of claim 10, comprising a drive adapted for moving the third registration member relative to the support surface, and wherein the controller is configured for moving the third registration member at least towards the second edge of the printing plate in the event that a presence of the electrical signal is detected by the first sensor and an absence of the electrical signal is detected by the second sensor.

14. The apparatus of claim 1, comprising an imaging system for forming an image on the printing plate.

15. The apparatus of claim 1, comprising a perforation system for perforating the printing plate after the printing plate has been registered on the support surface.

16. The apparatus of claim 1, wherein each actuator is a variable force actuator.

* * * * *